US006335089B1

(12) United States Patent
Skermer et al.

(10) Patent No.: US 6,335,089 B1
(45) Date of Patent: Jan. 1, 2002

(54) FIBRE-CLAY PANEL

(75) Inventors: Nigel A. Skermer, Penticton; John L. Dormer, Kamloops, both of (CA)

(73) Assignee: Pacific Bentonite Ltd., Kamloops (CA)

( * ) Notice: Subject to any disclaimer, the term of this patent is extended or adjusted under 35 U.S.C. 154(b) by 0 days.

(21) Appl. No.: 09/365,201

(22) Filed: Aug. 2, 1999

(51) Int. Cl.[7] ..... B32B 5/16
(52) U.S. Cl. ..... 428/332; 428/333; 428/351
(58) Field of Search ..... 428/332, 351, 428/333, 292.1

(56) References Cited

PUBLICATIONS

"Pulp Wood Fibre and Bentonite Clay App in Ind" 12,13.*
"Capping with Fiber clay" Floss et al., liv erg 62,63.*
"Pulp Wood Fibre and Bentonite Clay Applications in Industry" a Feasibility Study, May 6, 1997.
"Capping with Fiber Clay" article by Floess et al., Civil Engineering issue of Aug. 5, 1995, pp. 62–63.
Paraseal brochure of Mameco International, Inc.
Voltex brochure of Cetco Building Materials Group.
Bentomat brochure of Cetco Colloid Environmental Technologies Company.

* cited by examiner

*Primary Examiner*—Merrick Dixon
(74) *Attorney, Agent, or Firm*—Oyen Wiggs Green & Mutala

(57) ABSTRACT

A fiber-reinforced clay panel having low water permeability is made from a mixture of clay and primary clarifier recovered fiber, a waste material produced by pulp mills. The mixture is compressed and dried to form a panel having a rigidity like plywood and a very low coefficient of hydraulic conductivity. The panels are useful for lining and covering landfill and waste disposal sites, water-proofing basements and similar applications.

11 Claims, No Drawings

FIBRE-CLAY PANEL

TECHNICAL FIELD

The invention pertains to panels having low water permeability, and in particular to panels for use as liners, covers and water-proofing membranes, formed from a mixture of clay and wood fibres. The panels are intended for uses such as lining and covering waste disposal sites, and impermeable membranes for water-proofing basements and other underground structures.

BACKGROUND

Clay is known to be useful as a barrier to contain waste. It has low hydraulic conductivity and, under normal circumstances, is resistant to mineralogical changes. Compacted clay liners, made from a thick layer of clay compacted by tamping rollers have been used for waste impoundments. Such liners are made in the field and, in some cases, due to inappropriate or variable compacting techniques, they have failed. Adequate quality control is difficult in the field. Problems with swelling, shrinkage and cracking of compacted clay liners have also arisen.

It is also known to use clay as a liner material in the form of geosynthetic clay liners. In such products, which are used primarily for landfill applications, uncompacted clay particles are sandwiched between two layers of geotextile. Examples of such products are Bentomat (trademark), Claymix (trademark) and Voltex (trademark) manufactured by Colloid Environmental Technologies Company; and Bentofix (trademark) manufactured by Naue-Fasertechnik; and Paraseal (trademark) manufactured by Mameco International, Inc. Unlike compacted clay liners, which are simply made on the site where they are used, geosynthetic clay liners are factory-made products, typically taking the form of a blanket less than about 1 cm in thickness, which is sold in rolls. Being factory-made, they suffer much less from quality control problems compared to compacted clay liners made in the field. While geosynthetic clay liners are an established product, they are still developing technically. For example, care has to be taken in using ordinary sodium bentonite in a geosynthetic clay liner. Cases have been reported where the permeability of a liner has increased dramatically as a result of cation exchange taking place through the clay. Contamination by calcium and magnesium ions, as a result of placing a limestone cover over a geosynthetic clay liner, has depleted the sodium content in such cases. Proprietary chemical modification of the sodium bentonites can be used in order to make them more resistant to cation exchange. Problems have also arisen with the very low shear strength of wetted bentonite between the two layers of geofabric. This has been addressed by needle punching and stitching the two layers together. Problems also arise with respect to the effects of repeated cycles of wetting and drying on the hydraulic conductivity of the liner, and the effects of freeze-thaw cycling. These problems are not as yet fully resolved.

Further, geosynthetic clay liners are relatively expensive products. It would be desirable to provide a factory-made liner which includes clay but which does not require expensive geosynthetics. The present invention provides such a product, using pulp fibre waste which is available at virtually no cost as a waste material produced by pulp mills.

SUMMARY OF INVENTION

The invention provides fibre-reinforced clay liner panels made from a mixture of clay and primary clarifier recovered fibre ("PCRF"). Preferably, the mixture comprises clay in the range of 50–95% by weight and PCRF in the range of 50–5% by weight, both on a dry weight basis. The invention also provides a method of making such panels, comprising the steps of forming a wet mixture of the clay and PCRF, compressing the mixture to form a panel and drying it, under pressure, producing a panel which has a thickness preferably in the range of 2–30 mm and a coefficient of hydraulic conductivity less than $1\times10^{-9}$ m/sec.

Panels according to the invention are of a board-like or paper-like material rather than a textile-like material, as in the case of the geosynthetic clay liners.

DETAILED DESCRIPTION

The invention uses two principal components, clay and primary clarifier recovered fibre.

Clay is a naturally-occurring earth material found in mineable deposits in many places. It is composed mainly of fine particles (typically less then two microns) of hydrous aluminum silicates and other minerals. As used in the present invention, the clay is preferably one of, or a mixture of, clay minerals, principally montmorillonite (commonly known as bentonite), beidellite, nontronite, hectorite, saporite, attapulgite, sepiolite, vermiculite, hallyosite, kaolinite, illite, and chlorite. Montmorillonite is a naturally-occurring clay whose properties of low hydraulic conductivity, high cation exchange capacity and adsorption properties renders it particularly useful in the present invention. Calcium bentonite is preferred to sodium bentonite, as it is believed to be more resistant to cation exchange and therefore more stable as an impermeable membrane.

Primary clarifier recovered fibre (referred to herein as "PCRF") is a sludge-like pulp fibre waste material produced during the manufacture of pulp, formed during the processes of digesting and bleaching wood. It is a combination of the spillage and overflow from the kraft process, rejects from the brown stock and bleaching process, and rejected fibre due to dirt, wood dirt or color. It consists primarily of cellulose fibres. As obtained from a pulp mill, PCRF typically has a moisture content in the range of 65–85%, depending on the type of press used by the mill to squeeze out excess water.

Pulp mills in western Canada (and elsewhere) produce PCRF in abundance. It amounts to about 1% of the total production of pulp and its disposal is considered a mounting problem for the industry. At present, about half of it is burned and half goes to landfill sites. The present invention, in providing a commercial use for this waste product, can help alleviate this disposal problem.

In combination in the panels of the invention, the clay provides water tightness and cohesive strength and the cellulose fibres in the PCRF provide tensile resistance. The clay is not susceptible to biodegradation and, under non-aggressive conditions, is fairly resistant to chemicals. In combining the cellulose fibres and clay matrix to form a composite material, a high strength and low water permeability panel material is produced whose properties far transcend those of the original constituents.

Tensile stresses in covers can cause microcracking as well as larger visible cracks. This is a major drawback of conventional compacted clay covers. Cracking is caused by differential settlement, temperature fluctuations and shrinkage from drying. In the present invention, the increase in tensile strength provided by the pulp fibre intimately mixed with the clay is important in decreasing the cracking potential of the clay panels. This is important, for example, in covers for uranium mill tailings sites, where cracking can lead not only to increased hydraulic conductivity and accelerated rainfall infiltration, but increase in the release of radon gas from the uranium tailings. The long-term performance requirements for uranium tailings covers requires them to be effective for up to 1,000 years to the extent reasonably achievable, and in any case for at least 200 years. For this reason, uranium mill tailings covers are designed to depend on compacted clay covers, and synthetic liners are not used to meet long-term performance requirements. The present invention, preferably in combination with conventional compacted clay covers, should be a distinct improvement in minimizing cracking in covers.

"Panel" in this specification includes sheets, tiles, pads, slabs, boards and similar forms for the product of the invention. Fibre-reinforced clay panels according to the invention are made as follows. An intimate mixture of clay and PCRF is made, the clay comprising 50–95% (preferably about 75–85%) by dry weight of the mixture and the PCRF comprising 50–5% (preferably about 25–15%). The mixture is made with a water content preferably in the range of 100–150%, forming a slurry or paste-like consistency. The wet mixture is put in a pressing mold and is compressed to a flat panel at a pressure of about 15–200 kPa. The panel is then dried in an oven, preferably at a temperature not over 300° C. so as not to calcine the product. Pressure is applied during at least part of the drying process to prevent warping or curling of the panel. The thickness of the panel when dried is preferably between about 2 mm and 30 mm.

The panel thus formed can be cut by sawing to the desired size and shape, depending on the intended application. For example, it can be made square, rectangular, triangular, hexagonal, etc. The panel is semi-rigid, having a rigidity similar to plywood, and has significant compressive strength, tensile strength and bending resistance. In use, the clay in the panel is wettable and expansive, imparting a low water permeability to the panel, which has a coefficient of hydraulic conductivity that is preferably less than about $1\times10^{-9}$ m/sec. The amount of clay per square meter of panel is preferably not less than 5 kg on a dry weight basis.

Resin can be added to the mixture when making the product in order to impart increased strength to the panel.

The panels of the invention can be used as or as part of cover systems to control infiltration and as liner systems. Such uses include, for example, landfill caps and liners and surface or underground chemical storage. Depending on the application, the panels can be laid in an overlapping and staggered array (similar to the conventional arrangement of roofing shingles) or be placed adjacent to one another and sealed together by a sealant, or in other arrangements. The panels can also be used as water-proofing membranes for basements and other below-ground structures.

EXAMPLE

Calcium bentonite was obtained from the Hat Creek region of British Columbia. PCRF was obtained from the Weyerhaeuser pulp mill in Kamloops, B.C. A mixture comprising 80% clay and 20% PCRF, on a dry weight basis, was formed, by mixing these components thoroughly at a moisture content of about 120%, forming a paste. The paste was pressed between two plates at a pressure of 15 kPa to form a panel. The panel was heated in an oven 200° C. until it was substantially dry. Pressure was maintained on the panel during drying. The resulting panel was 2.5 mm thick, semi-rigid, having a compressive strength of over 400 kPa and substantial tensile strength and bending resistance. Long-term constant head permeability tests were carried out on the panel, under a hydraulic gradient of 100 for a period of nine months. The coefficient of hydraulic conductivity was determined to be less than $5\times10^{-9}$ m/sec, within the limits of experimental error.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A fibre-reinforced clay panel having low water permeability, comprising a mixture which comprises clay in the range of 50–95% by weight of said mixture, on a dry weight basis, and PCRF in the range of 50–5% by weight of said mixture, on a dry weight basis, said panel being formed by compressing and drying said mixture.

2. A panel according to claim 1 wherein said clay comprises one of, or a mixture of, the clay minerals bentonite, beidellite, nontronite, hectorite, saporite, attapulgite, sepiolite, vermiculite, hallyosite, kaolinite, illite, and chlorite.

3. A panel according to claim 1 wherein said clay is calcium bentonite.

4. A panel according to claim 1 or 2 wherein said panel has a coefficient of hydraulic conductivity, less than $1\times10^{-9}$ m/sec.

5. A panel according to claim 1 wherein said panel has a thickness in the range of 2–30 mm.

6. A panel according to claim 1 wherein said mixture further comprises resin.

7. A panel according to claim 1 wherein the percent clay is in the range of 75–85% and the percent of PCRF is in the range of 25–15%.

8. A method of making a fibre-reinforced clay panel having low water permeability, comprising the steps of:

(a) forming a wet mixture of clay and PCRF, said clay being in the range of 50–95% by weight of said mixture on a dry weight basis, and said PCRF being in the range of 50–5% by weight of said mixture on a dry weight basis;

(b) compressing said mixture to form a panel; and (c) drying said panel.

9. A method according to claim 8 wherein compressive pressure is maintained on said panel during at least a part of said drying step.

10. A method according to claim 9 wherein said compressing of said mixture is done at a pressure of 15–200 kPa.

11. A method according to claim 9 wherein the percent play is in the range of 75–85% and the percent of PCRF is in the range of 25–15%.

* * * * *